US006122462A

United States Patent [19]

Hintler

[11] Patent Number: 6,122,462

[45] Date of Patent: Sep. 19, 2000

[54] COMMUNICATION ARRANGEMENT IN ELECTROGRAPHIC PRINTER AND COPIER DEVICE

[75] Inventor: Franz Hintler, Aschau, Germany

[73] Assignee: Oce Printing Systems GmbH, Poing, Germany

[21] Appl. No.: 09/066,417

[22] PCT Filed: Aug. 5, 1996

[86] PCT No.: PCT/DE96/01463

§ 371 Date: Sep. 4, 1998

§ 102(e) Date: Sep. 4, 1998

[87] PCT Pub. No.: WO97/16771

PCT Pub. Date: May 9, 1997

[30] Foreign Application Priority Data

Oct. 31, 1995 [DE] Germany ..... 195 40 672

[51] Int. Cl.[7] ..... G03G 15/00

[52] U.S. Cl. ..... 399/77

[58] Field of Search ..... 399/9, 10, 31, 399/75, 76, 77; 714/44, 47; 710/19

[56] References Cited

U.S. PATENT DOCUMENTS

| | | | |
|---|---|---|---|
| 4,062,061 | 12/1977 | Batchelor et al. | 395/184.01 |
| 4,306,803 | 12/1981 | Donohue et al. . | |
| 4,523,299 | 6/1985 | Donohue et al. | 399/77 |
| 4,811,052 | 3/1989 | Yamakawa et al. | 399/77 |
| 5,087,940 | 2/1992 | Atlmann | 399/77 |
| 5,138,376 | 8/1992 | Maruta et al. . | |
| 5,164,769 | 11/1992 | Hashimoto et al. | 399/77 |
| 5,283,613 | 2/1994 | Midgley, Sr. | 399/9 |
| 5,471,313 | 11/1995 | Thieret et al. | 358/296 |
| 5,895,140 | 4/1999 | Koh et al. | 399/77 |

OTHER PUBLICATIONS

Embacher, "CAN–Chip macht Karosserie–elektronik erschwinglich", Elektronic, vol. 43, No. 36, Dec. 1994, pp. 102–105.

Phillips Semiconductor, 80C51–Based 8–Bit Microcontrollers, 1994, 4 pages.

*Primary Examiner*—Robert Beatty

*Attorney, Agent, or Firm*—Hill & Simpson

[57] ABSTRACT

A unified bus system is used for communication in a printer or copier apparatus. Each functional unit of the printer or copier apparatus is connected to the bus by an interface. The interface includes a duel-port RAM memory unit in which data messages associated with the specific functional unit or sensors in the printer or copier apparatus are stored. The functional units are notified of the presence of new data or messages on demand so that each functional unit has an overall picture of the functional status of the printer or copier.

7 Claims, 3 Drawing Sheets

COMMUNICATION ARRANGEMENT IN ELECTROGRAPHIC PRINTER AND COPIER DEVICE

BACKGROUND OF THE INVENTION

1. Field of the Invention

The present invention is directed to a communication means in an electrographic printer or copier device. A plurality of function units such as a fixing station, a character generator, a paper transport means, a central control unit, etc., are contained in an electrographic printer or copier device. Over and above this, there are numerous smaller function units such as, for example, sensors, motors, switches, keys, etc. The functionality of all of these function units must be coordinated for the operation of the printer or copier device.

2. Description of the Related Art

Bus systems that are controlled via a main module HM are utilized in known printer or copier devices for the coordination of approximately 100 sensors and approximately 40 power consuming units. The structure of such a known control system may be seen from FIG. 1. The signal transmission between the main module HM and the sub-modules SUB1 . . . SUBn ensues via a first bus system BBUS. One sub-module SUB1 . . . SUBn controls power consumers LV, acquires data from sensors, and exchanges data and messages with other sub-modules SUB1 . . . SUBn. The power consumers LV are directly controlled by the sub-modules SUB1 . . . SUBn via individual lines, and sensor assemblies SPU1 . . . SPUn for editing the information acquired by the sensors are inserted between the sub-module SUB1 . . . SUBn and individual sensors ES. The sub-modules SUB1 . . . SUBn communicate with the sensor assemblies via second bus system VBUS. The second bus system VBUS can, for example, be a coupling with a parallel V24 interface. The communication between the sensor assemblies and the sub-modules ensues on the basis of what is referred to as a polling method wherein a submodule SUB1 . . . SUBn interrogates desired data from a sensor assembly SPU1 . . . SPUn. The communication between the sub-modules SUB1 . . . SUBn also ensues according to this polling method, whereby the main module HM can be viewed as a master and the sub-modules SUB1 . . . SUBn can be viewed as slaves.

The data traffic between the individual sub-modules SUB1 . . . SUBn can thereby only be sequenced in dialog traffic between the sub-modules SUB1 . . . SUBn and the main module HM. This, for example, means that a message of a sensor ES to a sub-module SUBn must be communicated from this sub-module SUBn to the main module HM and from the latter to the other sub-module SUB1 . . . SUB3. Over and above this, synchronous control commands can only be transmitted asynchronously to the individual sub-modules SUB1 . . . SUBn.

In addition to the long program running time, the known interrogation method also causes an increased wiring outlay since parallel wiring is required. The efficiency of the interrogation method is also low because conditions that have not changed since the preceding interrogation are frequently interrogated. The data traffic, which can only be sequenced between the master and slave, is coordinated with a priority control by a single control unit contained in the main module HM. Delays in the function execution of the printer or copier device can thus occur. This fact is countered in that fast signal changes are handled with what is referred to as a parallel port interrogation.

SUMMARY OF THE INVENTION

The present invention is based on the object of providing a communication means and a communication method for an electrographic printer or copier device that assures a fast, delay-free communication which at the same time requires little outlay for wiring and provides a high dependability.

This and other objects and advantages of the invention are achieved by a communication means in an electrographic and copier device having a plurality of function units that are coupled to one another for data communication that includes a coupling of the function units with a uniform bus system, an interface to the bus system allocated to each function unit that contains a memory unit with random access in which specific information respective to the function units can be deposited in defined address areas, and these information are continuously updated in all interfaces by the bus system so that each function unit has an overall picture of the function statuses in the electrographic printer and copier device available to it all the time.

The present invention also provides a method for communication in an electrographic printer and copier device between a plurality of function units that are coupled to one another by a uniform bus system for data communication, the method including the steps of: given an initialization, interfaces to the bus system that are allocated to each function unit are placed into a basic condition so that the basic condition data of all function units are available in address areas respectively defined therefor in a memory unit with random access that is contained in each interface; upon occurrence of a change of a condition of a function unit, this change is entered in the effected memory area of the memory unit that is allocated to the function unit; and this change is transmitted with the bus system to the interfaces of all function units and is respectively deposited thereat in the effected address area of the memory unit, so that each function unit has an overall picture of the function conditions in the electrographic printer and copier device available to it all the time.

Particular developments and improvements of the invention are provided by a message-oriented system that immediately communicates modification of information to all function units.

In one embodiment, a memory unit that is a dual port RAM is provided in each function unit, the address area of the memory being divided into two individual areas, whereby the first address area serves for accepting data and messages and the second address area serves for accepting information with respect to the data and messages deposited in the first address area.

The communication apparatus provides an allocation of a respective data or message block to an information block so that the addresses of the respectively first byte of the blocks have a specific address spacing from one another.

Two first-in-first-out registers are preferably allocated to the interface, whereof one can be written at the bus side and read at the function unit side and the other can be written and read in the opposite direction; the address of a data or message block and the length thereof in the memory unit can be entered into these FIFOs with random access, and the read out of these information starts an interrupt routine in the reading processor.

A further interface to the bus system can be utilized for coupling function units with slight control jobs to the bus system, whereby the further interface is configured such that it only allows data and messages destined for the respective function unit to pass.

In the method, a memory unit fashioned as what is referred to as a dual port RAM is provided in each function unit, the address area thereof being divided into two individual areas, whereby, given a change of a condition of a function unit, data and messages are entered in the first address area and information with respect to the data and messages deposited in the first address area are entered into the second address area.

Two first-in-first-out registers are allocated to the interface, whereof one can be written at the bus side and read at the function unit side and the other can be written and read in the opposite direction, whereby, dependent on the information deposited in the memory unit with respect to data and messages to be modified, the address of a data or message block and the length thereof is entered into the respectively effected FIFO and the read-out of this information starts an interrupt routine in the reading processor.

Due to the inventive employment of a uniform bus system that couples the function units to one another for data communication, a data exchange will always ensue directly between the function units. Each interface of a function unit can thereby be viewed as a master, for which reason the communication occurs only between masters. As a result of the defined address areas in the memory units of the interfaces, which are always updated by the bus system, every function unit always has the current information in the printer or copier device available to it. A complicated requesting of information by an interface defined as a slave from the master is eliminated. An inquiry by a function unit about the condition of other function units ensues by simple access to its own memory unit of the interface. This requires comparatively little time, as a result whereof the function unit is only slightly loaded by the communication relationship to the other function units.

According to a development and improvement of the invention, the memory unit of the interface is fashioned as a dual port RAM. This advantageously allows a simultaneous access on the part of the function unit and of the bus system to the memory unit. Moreover, the dual port RAM is divided into two address areas wherein, data and messages are deposited in the first area and information with respect to these data and messages are deposited in the other area. As a result thereof, the requested data can be designationally accessed. Advantageously, the distance of the start byte of the data and messages that are allocated to one that are another from the information is selected in a specific address spacing. This facilitates the addressing; particularly when, for example, a spacing of 2 k/byte, only some other address bits following access to the first block need be modified for the access to the appertaining of the block.

The information with respect to a status of a function unit, for example, whether a specific motor is operating, is deposited in the data or message block. Information about the data and message block are contained in the appertaining information block. This can be an identifier in accord wherewith this is new information that must be transmitted. It can also be information about the way the information is to be reported from the memory unit to the function unit. The information can be independently called by the function unit (RTR) bit, or an interrupt request brings the presence of new information in the dual port RAM to the attention of the function unit. Since this can be different from function unit to function unit, the information blocks in the different dual port RAMs can differ from one another. The information blocks can be updated as needed during the printing operation.

According to a further improvement and development of the invention, two first-in-first-out (FIFO) registers are allocated to the memory unit. These FIFO registers have an FIFO-empty line available to them that triggers an interrupt routine at their allocated reception processor. The address of a data or message block and the length thereof is entered into the FIFO registers when the processor entering into the memory unit recognizes with reference to the information in the information block that an interrupt routine is to be initiated. In this way, a receiving processor can process the messages and data intended for it when its work execution allows this. At the other side, the transmitting processor can deliver independently of the receiving processors dependent on the depth of the FIFO, for example, 128 messages.

According to a further development and improvement of the invention, function units that do not carry out any specific control job can also be coupled to the bus system by a further interface. For example, such function units serve for sensor acquisition and evaluation. These function units only receive information intended for them. The other information are blanked out by the interface. As a result of this development, simple function units can be directly coupled to the bus system with little outlay. A loading of the other function units due to direct coupling of the simple function units to them is eliminated.

BRIEF DESCRIPTION OF THE DRAWINGS

An example of the invention is explained in greater detail below with reference to the Figures.

DETAILED DESCRIPTION OF THE PREFERRED EMBODIMENTS

Figure 1:
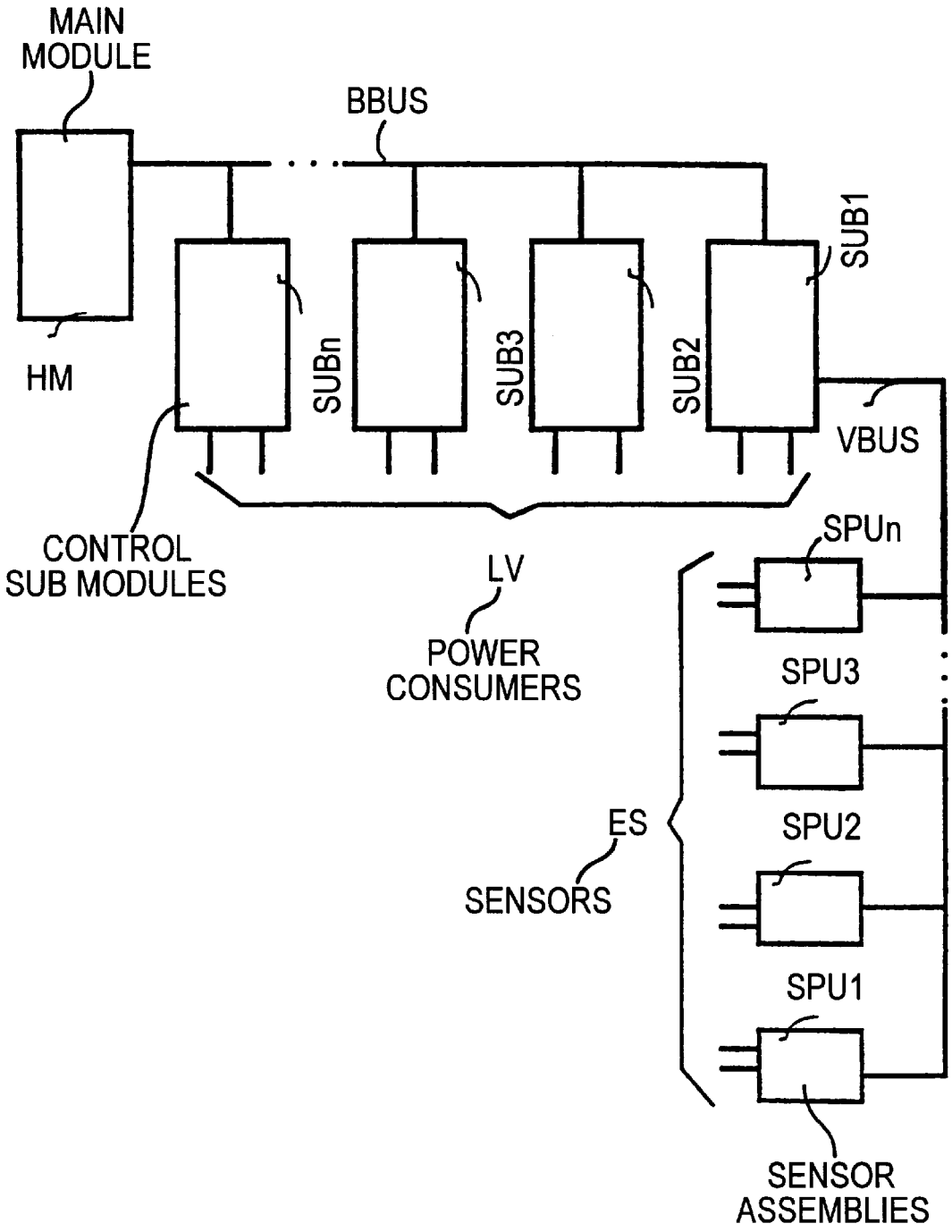
FIG 1 (PRIOR ART)
FIG. 1 is a block diagram of a communication means according to the prior art.
Figure 2:
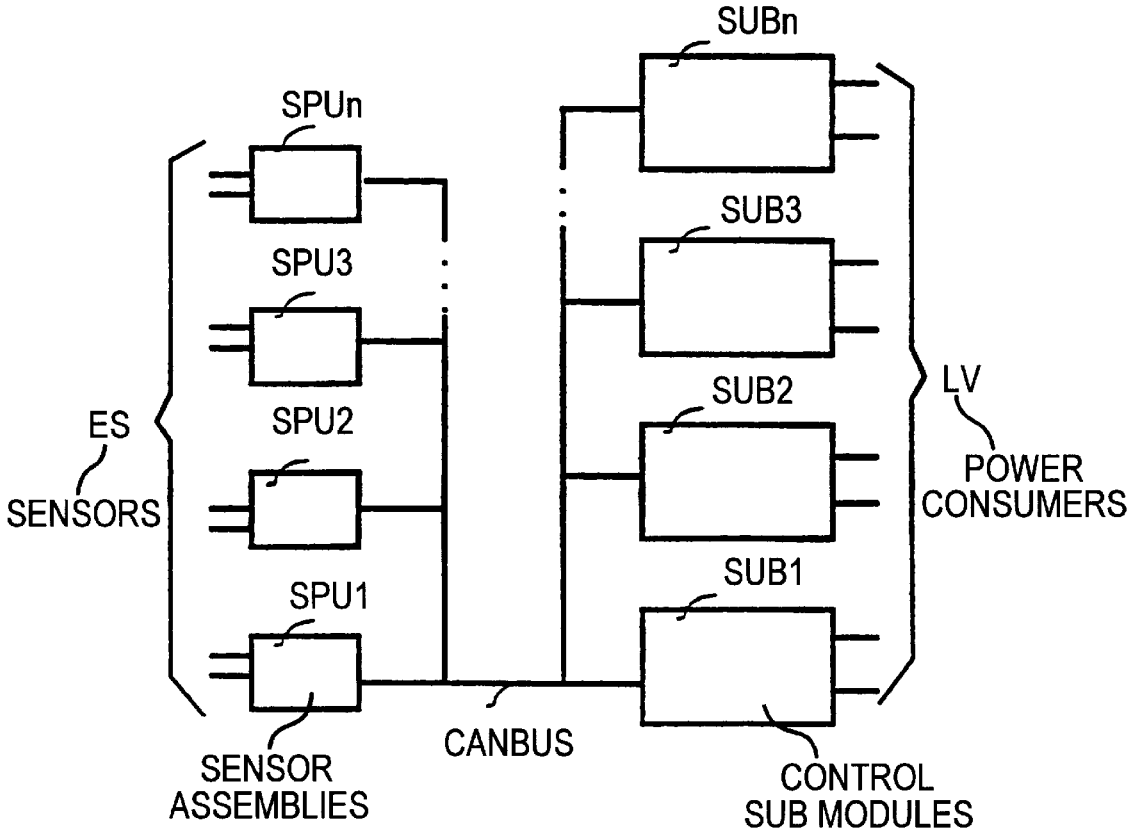
FIG. 2 is an inventive communication means in block presentation of function modules that are coupled to one another by a bus system.

Eight function units SUB, SPU of a printer and copier device are shown in the communication means according to FIG. 2. All function units SPUx and SUBx are coupled to one another for communication by a uniform bus system CANBUS. The sub-modules SUB1 . . . SUBn form a first group of function units. These sub-modules SUB1 . . . SUBn are, for example, the submodules for control of the paper transport, control of the fixing station, as well as the central control of the printer or copier device. These sub-modules SUB1 . . . SUBn control the units such as motors, heating devices and other power consumers LV that are allocated to them on the basis of sensor elements allocated to these units. The other function units are a matter of simple sensor assemblies that control keys, switches, display elements, temperature sensors, motors and sensors located outside the sub-modules SUB1 . . . SUBn.

Figure 3:
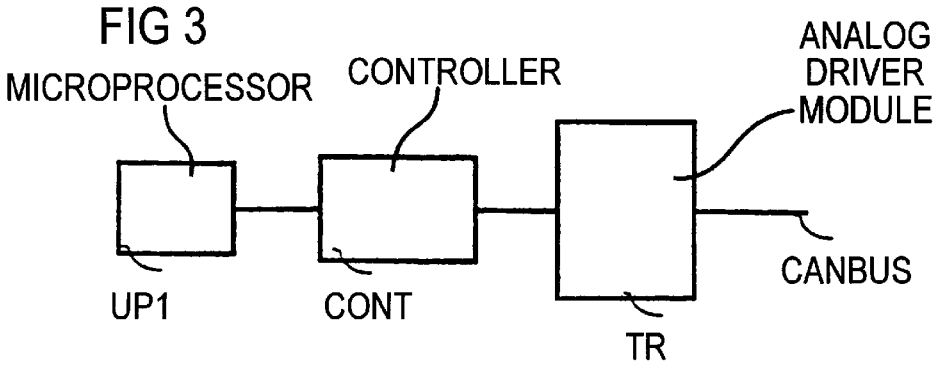
FIG. 3 is a simplified interface arrangement in block presentation with message filters.

The coupling of these sensor assemblies SPU1 . . . SPUn to the bus system CANBUS ensues with an interface according to FIG. 3. The sensor assembly SPU1 . . . SPUn has a first microprocessor UP1, for example of the type 80C535, available to it that controls and monitors the function elements allocated to the sensor assembly and outputs occurring messages to a following controller CONT, for example of the type 82C200, or receives them. This controller CONT only allows those messages and data from the bus system CANBUS to pass that are required for the functionability of the sensor assembly SPU1 . . . SPUn. The number of these relevant data messages is extremely low, so that the controller CONT only has a transmission memory and two selectable reception memories available to it. The linking of the controller CONT to the bus system CANBUS ensues via an analog driver module TR of, for example, the type 82C250. A level matching to the bus system CANBUS ensues in this driver module TR.

Figure 4:
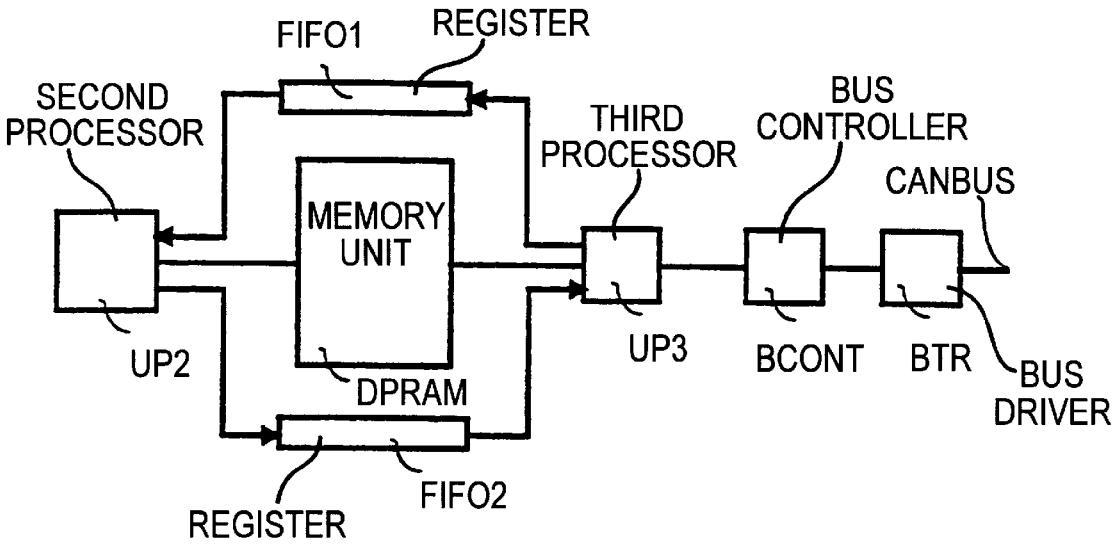
FIG. 4 is an interface arrangement in block presentation with dual port RAM and FIFO registers.

The data set to be processed by the other interfaces that are allocated to the sub-modules SUB1 . . . SUBn is significantly larger. FIG. 4 shows an interface that can process these data sets. A second microprocessor UP2 serves for the control of a sub-module SUB1 . . . SUBn. For example, the circuit type 80C167 can be utilized as second microprocessor UP2. This microprocessor UP2 communicates with the bus system CANBUS via a memory unit DPRAM. A third microprocessor UP3 of, for example, the circuit type 80C535 is utilized for coupling the memory unit DPRAM to the bus system CANBUS. It communicates with a bus controller BCONT and the latter communicates with a bus driver BTR. The circuit type 80C200 can be utilized as the bus controller BCONT and the circuit type 80C250 can be utilized as bus driver BTR. The second and the third microprocessor UP2 and UP3 communicate directly with the memory unit DPRAM. The memory unit is a dual port RAM DPRAM.

Figure 5:
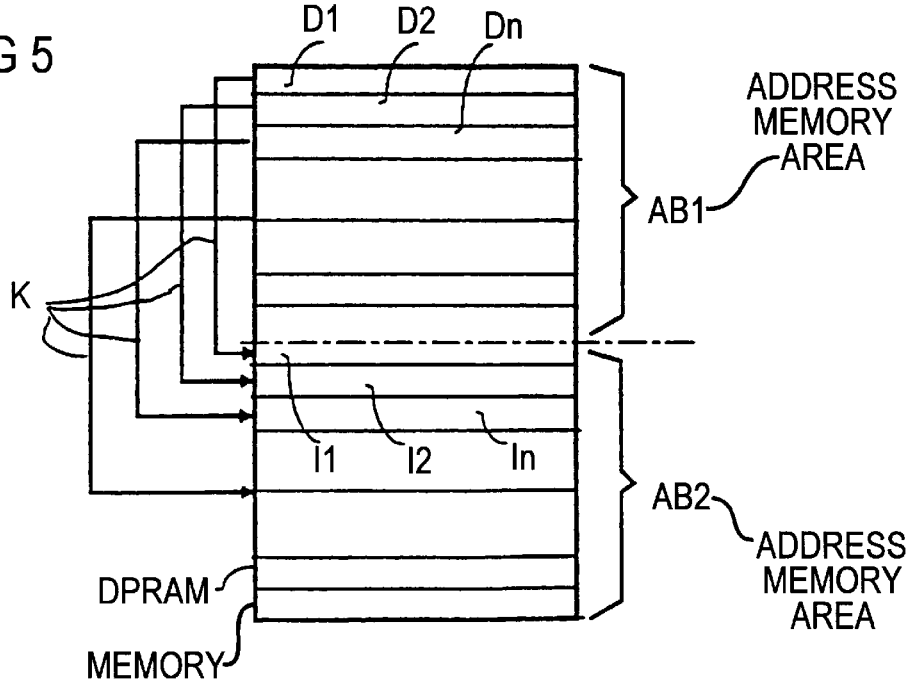
FIG. 5 is a schematic illustration of a dual port RAM divided into two memory areas.

This dual port RAM DPRAM is structured as shown in FIG. 5. The entire address area of the dual port RAM DPRAM is divided into address areas AB1 and AB2. An address in the second address area AB2 is thereby allocated to every address in the first address area AB1. The spacing K between the addresses allocated to one another is always the same and amounts, for example, to 2 KBytes. Data and messages are deposited in the first address area AB1, and information about the data and messages of the first section AB1 are deposited in the second address area AB2.

The data and messages of the first address area AB1 are structured in blocks. A block one, D1, D2, Dn is identified by a start address and is a maximum of eight bytes long. The second section AB2 is likewise structured in blocks I1, I2, In. Each block I1, I2, In of the second address area AB2 contains information of the block D1, D2, Dn of the first address area AB1 allocated to it. The spacing K of the start addresses of the blocks D1, I1, . . . Dn, In, of the different sections AB1 and AB2 which are related to one another corresponds to the spacing K of the addresses of the different address areas AB1 and AB2 from one another.

The information in the second address area AB2 relate to the respectively appertaining data and message block. These information can be an identifier, in accordance therewith it is new information that must be sent. It can also be information about the way in which the information is to be reported from the memory unit DPRAM to the function unit. The information can be independently called by the function unit (RTR bit) or an interrupt request brings the presence of new information in the dual port RAM DPRAM to the attention of the function unit. The length of the data of the appertaining data block in the first address area AB1 is also a component part of the information block I1 . . . In. In general, accordingly, it is a matter of information about how the data and messages D1 . . . Dn are to be further-processed.

When one of the processors UP2 or UP3 enters data or messages D1 . . . Dn into the first address area AB1 of the dual port RAM DPRAM, then, by reading out the corresponding information block I1 . . . In from the dual port RAM DPRAM, it conforms itself of the way in which the processor UP2 or UP3 lying opposite should obtain possession of these data or messages D1 . . . Dn. When it is a matter of data or messages D1 . . . Dn that the processor lying opposite can fetch itself without having to be informed thereof, the data are transmitted in a valid fashion by the entry into the first address area AB1. When, however, it proceeds from the information of the second address area AB2 that the receiving microprocessor UP2 or UP3 is to be informed of the data or messages D1 . . . Dn by an interrupt routine, then the transmitting processor UP2 or UP3 enters the address of the first descriptive byte of a message in the first address area AB1 and the appertaining data length into a first-in-first-out (FIFO) register FIFO1 or FIFO2. The FIFO register FIFO1, FIFO2, contains an FIFO empty line that is coupled to the receiving processor UP2 or UP3 and triggers an interrupt in the receiving microprocessor UP2 or UP3 dependent on the memory entry in the FIFO register FIFO1 or FIFO2.

Each FIFO register FIFO1 and FIFO2 is responsible for one transmission direction. Thus, the first FIFO register FIFO1 is written by the third microprocessor UP3 and is read by the second microprocessor UP2. The second FIFO register FIFO2 is written by the second microprocessor UP2 and read by the third microprocessor UP3. The FIFO registers FIFO1 and FIFO2 can accept 128 different messages that are intended to trigger an interrupt. These messages can be successively processed without modifying their sequence.

The above-described selection method is advantageous upon reception of data by a function unit SUB1 . . . SUBn because the second microprocessor UP2 is only made use of when it is a matter of messages to be taken immediately into consideration. When, however, the function unit SUB1 . . . SUBn has generated new data or messages D1 . . . Dn, then these must be immediately available for the other function units SUB1 ... SUBn, SPU1 . . . SPUn. Only then is a friction-free function execution possible without a waiting time in the printer or copier device.

The immediate delivery of data or messages D1 . . . Dn is promoted in that the second microprocessor UP2 undertakes an entry in the second FIFO register FIFO2 given the presence of a new message. This ensues independently of the information in the second address area AB2 of the dual port RAM DPRAM. The third microprocessor UP3 will thus transmit the data or message to the other function units SPUx and SUBx via the bus system CANBUS at the next opportunity.

Since, depending on whether it is a matter of an interface with the dual port RAM or with the controller CONT, the bus interfaces of all function units SPU1 . . . SPU3, SUB1 . . . SUBn are identically constructed, a current image of all sensors, users and control statuses of the printer or copier device is always available to each function unit SUB1 . . . SUBn, SPU1 . . . SPUn. The allocation of data or messages D1 . . . Dn is therefore especially simple because the same address is allocated to these data or messages D1 . . . Dn in every dual port RAM DPRAM. For example, data or messages D1 . . . Dn to the sensor 1 are deposited under the start address 100 of a memory DPRAM. After their communication, these data or messages D1 . . . Dn are available quasi time-synchronously in all dual port RAMs DPRAM of the other function units SUB1 . . . SUBn. They merely have to be read beginning with the address 100.

Since information are transmitted over the bus system CANBUS only message-oriented, i.e. only when data or messages D1 . . . Dn change, the data traffic on the bus system CANBUS is reduced to a minimum. A bus system CANBUS that can be utilized for the above-described communication jobs is known from the CANBUS specification 2.0, parts A and B of April 1994 of the Philips Company.

Although other modifications and changes may be suggested by those skilled in the art, it is the intention of the inventors to embody within the patent warranted hereon all changes and modifications as reasonably and properly come within the scope of their contribution to the art.

What is claimed is:

1. A communication arrangement in an electrographic printer and copier device having a plurality of function units that are coupled to one another for data communication, comprising:

a uniform bus system connected between the function units;

an interface to the uniform bus system allocated to each of the function units, said interface including a memory unit with random access in which information specific to respective ones of the function units is deposited in defined address areas, and these information are continuously updated in all interfaces by the bus system, so that each of said function units has an overall picture of function statuses in the electrographic printer and copier device available to it at all times; and said memory unit is a dual port RAM in each of said function units whose address area is divided into first and second individual areas, whereby the first individual area serves for accepting data and messages and the second individual area serves for accepting information with respect to the data and messages deposited in the first individual area.

2. A communication arrangement according to claim 1, comprising:

a message-oriented system that immediately communicates a modification of an information to all of said function units.

3. A communication arrangement according to claim 1, comprising:

an allocation of a respective data or message block to an information block, so that addresses of a first byte of the blocks have a specific address spacing from one another.

4. A communication arrangement according to claim 1, comprising:

two first-in-first-out registers allocated to the interface, whereof one of said first-in-first-out registers is connected to be written at a bus side and read at a function unit side and the other of said first-in-first-out registers is connected to be written and read in an opposite direction; an address of a data or message block and a length thereof in the memory unit can be entered into said first-in-first-out registers with random access, and the read out of these information starts an interrupt routine in the reading processor.

5. A communication arrangement according to claim 1, comprising:

a further interface to the bus system that is connected to be utilized for coupling function units to the bus system, whereby the further interface is configured such that it only allows data and messages destined for a respective function unit to pass.

6. A method for communication in an electrographic printer and copier device between a plurality of function units that are coupled to one another by a uniform bus system for data communication, comprising the following method steps:

given an initialization, placing interfaces to the bus system that are allocated to each function unit into a basic condition so that the basic condition data of all function units are available in address areas respectively defined therefor in a memory unit with random access that is contained in each interface;

upon occurrence of a change of a condition of a function unit, entering said change in the effected memory area of the memory unit that is allocated to the function unit;

transmitting said change with the bus system to the interfaces of all function units and depositing thereat in the effected address area of the memory unit, so that each function unit has an overall picture of function conditions in the electrographic printer and copier device available to it at all times; and said memory unit is a dual port RAM in each of said function units, an address area thereof being divided into two individual areas, whereby, given a change of a condition of a function unit, data and messages are entered in a first of said individual areas and information with respect to the data and messages deposited in the first individual address area are entered into the second of said individual areas.

7. A method for communication according to claim 6, comprising the step of:

two first-in-first-out registers allocated to the interface, whereof one of said first-in-first-out registers is connected to be written at a bus side and read at a function unit side and the other of said first-in-first-out registers is connected to be written and read in an opposite direction, whereby, dependent on information deposited in the memory unit with respect to data and messages to be modified, an address of a data or message block and a length thereof is entered into a respectively effected one of said first-in-first-out registers and read-out of this information starts an interrupt routine in the reading processor.

* * * * *